US005353461A

United States Patent [19]

Enriquez

[11] Patent Number: 5,353,461

[45] Date of Patent: Oct. 11, 1994

[54] ROTARY SCRUBBER APPARATUS

[76] Inventor: Kevin Enriquez, 1864 Madison St., #1 Right, Queens, N.Y. 11385

[21] Appl. No.: 123,054

[22] Filed: Sep. 20, 1993

[51] Int. Cl.[5] ..... A46B 13/02; A47L 15/37

[52] U.S. Cl. ..... 15/23; 15/28; 15/97.1; 15/104.095

[58] Field of Search ..... 15/23, 24, 28, 29, 97.1, 15/104.04, 104.05, 104.095; 51/170 R, 173, 170 PT, 170 T

[56] References Cited

U.S. PATENT DOCUMENTS 2,662,238 12/1953 Robey ..... 15/23

2,911,660 11/1959 Klemas et al. ..... 15/28

3,451,086 6/1969 Burgett ..... 15/23

4,137,588 2/1979 Sandt et al. ..... 15/23

4,275,749 6/1981 Caroli ..... 15/23

*Primary Examiner*—Edward L. Roberts

*Attorney, Agent, or Firm*—E. Michael Combs

[57] ABSTRACT

A rotary scrubber includes an elongate housing having a rotary axle projecting therefrom, with the rotary axle mounting a brush member. A deflecting shield is positioned circumferentially relative to the brush member to deflect fluid therefrom, wherein the shield is arranged for deflection to accommodate various configuration of workpieces to be engaged by the rotary brush.

3 Claims, 4 Drawing Sheets

ROTARY SCRUBBER APPARATUS

BACKGROUND OF THE INVENTION

1. Field of the Invention

The :field of invention relates to rotary brush structure, and more particularly pertains to a new and improved rotary scrubber apparatus wherein the same is directed to the clearing of various workpieces such as dishes, pots, pans, and the like.

2. Description of the Prior Art

Scrubber apparatus of various types have been employed in the prior art for the cleaning of various components such as in U.S. Pat. No. 4,060,871 indicating a rotary brush directed for rotation by fluid pressure.

The instant invention attempts to overcome deficiencies of the prior art by providing for a fluid impermeable housing mounting a rotary brush, wherein the housing is arranged to prevent fluid access therewithin to permit ease of cleaning of the housing, with the brush having a deflecting shield mounted circumferentially relative to the brush to deflect fluid relative to a user.

SUMMARY OF THE INVENTION

In view of the foregoing disadvantages inherent in the known types of scrubber apparatus now present in the prior art, the present invention provides a rotary scrubber apparatus wherein the same includes an elongate housing rotatably mounting a brush extending therefrom. As such, the general purpose of the present invention, which will be described subsequently in greater detail, is to provide a new and improved rotary scrubber apparatus which has all the advantages of the prior art rotary scrubber apparatus and none of the disadvantages.

To attain this, the present invention provides a rotary scrubber including an elongate housing having a rotary axle projecting therefrom, with the rotary axle mounting a brush member. A deflecting shield is positioned circumferentially relative to the brush member to deflect fluid therefrom, wherein the shield is arranged for deflection to accommodate various configuration of workpieces to be engaged by the rotary brush.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved rotary scrubber apparatus which has all the advantages of the prior art rotary scrubber apparatus and none of the disadvantages.

It is another object of the present invention to provide a new and improved rotary scrubber apparatus which may be easily and efficiently manufactured and marketed.

It is a further object of the present invention to provide a new and improved rotary scrubber apparatus which is of a durable and reliable construction.

An even further object of the present invention is to provide a new and improved rotary scrubber apparatus which is susceptible of a low cost of manufacture with regard to both materials and labor, and which accordingly is then susceptible of low prices of sale to the consuming public, thereby making such rotary scrubber apparatus economically available to the buying public.

Still yet another object of the present invention is to provide a new and improved rotary scrubber apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
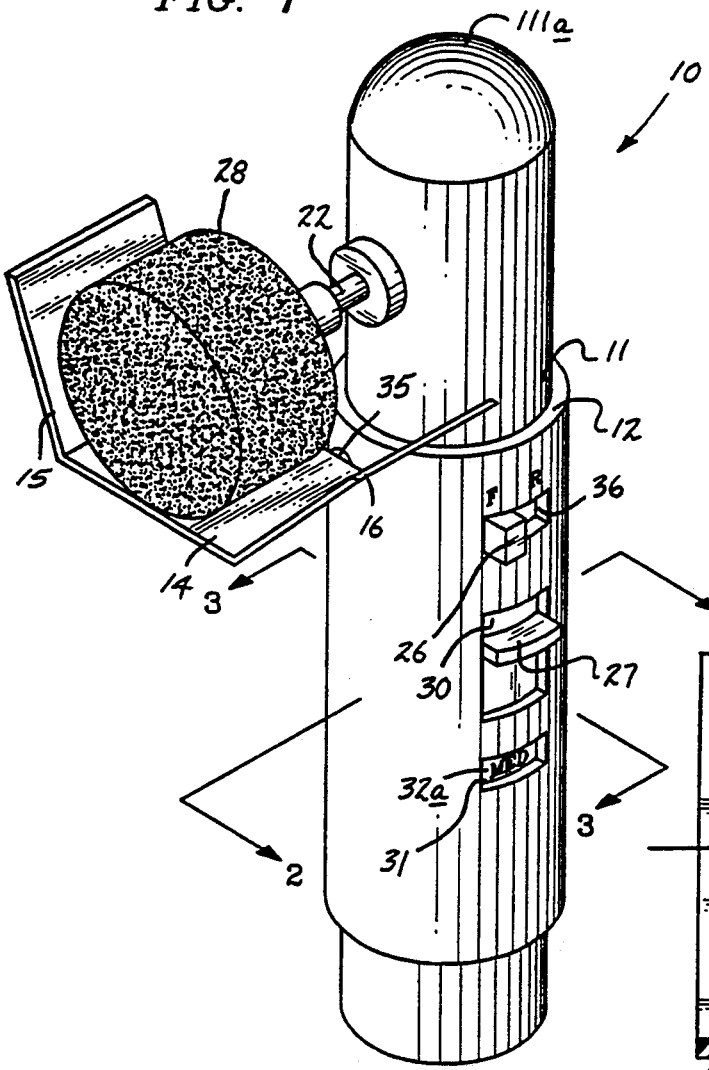
FIG. 1 is an isometric illustration of the invention.

With reference now to the drawings, and in particular to FIGS. 1 to 7 thereof, a new and improved rotary scrubber apparatus embodying the principles and concepts of the present invention and generally designated by the reference numeral 10 will be described.

More specifically, the rotary scrubber apparatus 10 of the instant invention essentially comprises an elongate housing 11 symmetrically oriented about a housing axis 11*a*, having a resilient sheath 12 extending about the housing, with the sheath arranged for ease of manual grasping and securement of the organization in use. A U-shaped splash guard 13 is provided fixedly secured to the housing 11 by a shield mounting rod formed of a shape retentive material permitting the guard 13 to deflect in use, such that the guard includes a first plate 14 of a rigid material, having second and third plates 15 and 16 extending from opposed sides of the first plate, with the second and third plates formed of a resilient material permitting deflection of the splash guard and more specifically, the second and third plates in use, as well as the mounting rod 35. A housing web 17 within the housing 11 hermetically seals a drive motor 18 within the hermetically sealed chamber 23. The drive motor includes an output shaft 19 having a first gear 20 cooperative with a second gear 21 to effect the rotation of an axle 22 in a reversible manner through a reversing switch 26. Batteries 24 cooperate with the drive motor 18 through a reversing switch 26 and a speed control switch member 34.

Figure 7:
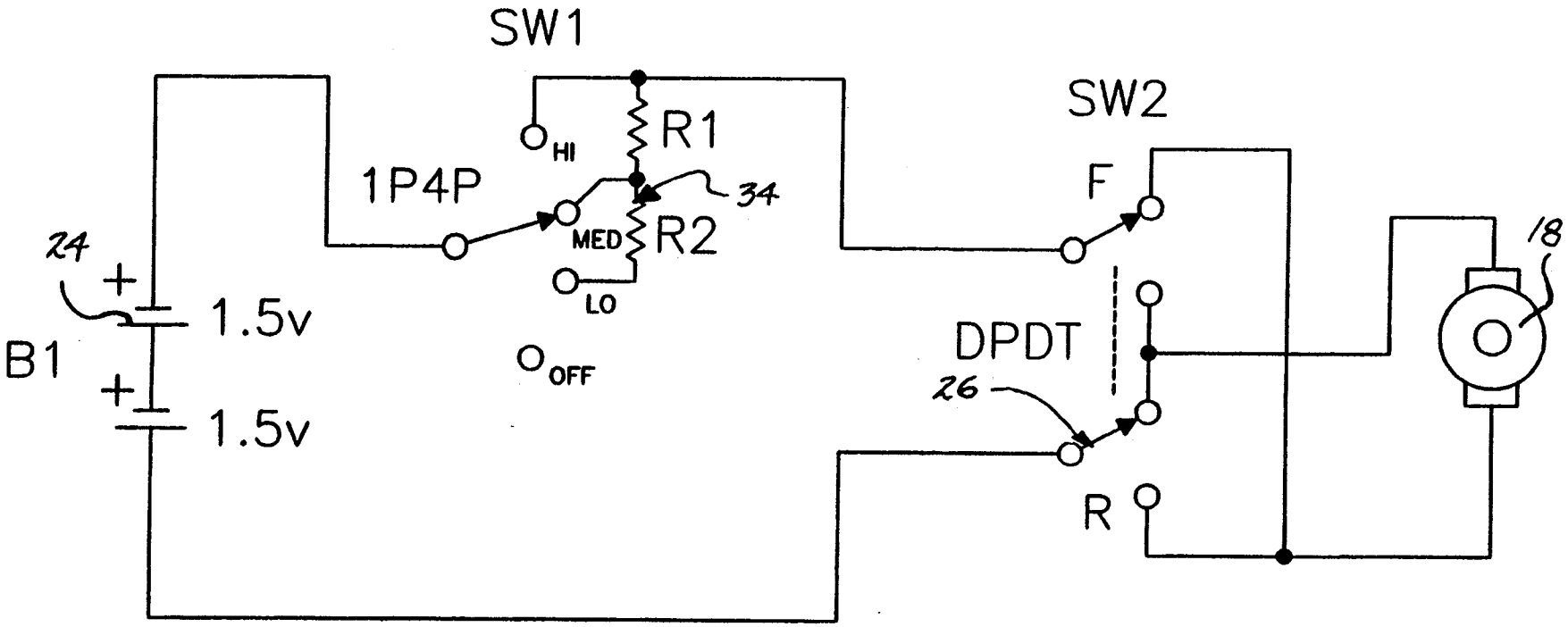
FIG. 7 is a schematic diagrammatic illustration of the switch structure in cooperation with the batteries and drive motor of the invention.

The batteries 24 (see FIG. 7) cooperates through the speed control switch member 34, in a manner as indicated in FIG. 7, having an off position, a low speed, a medium speed, and a high speed, wherein the low speed cooperates through resistors 1 and 2, the medium speed cooperates through resistor 1, and the high speed bypasses the resistors 1 and 2 directing full voltage to the drive motor 18. The reversing switch 26 is a double pole double throw type for reversing direction of the drive motor 18.

A cylindrical brush head 28, as illustrated in FIG. 1, extends axially beyond the housing uppermost end 111*a*, with the circumference of the brush head 28 extending beyond the uppermost end 111*a* along the housing axis 11*a*. It should be noted that the brush axis 28*a* is orthogonally oriented relative to the housing axis 11*a*.

Figure 4:
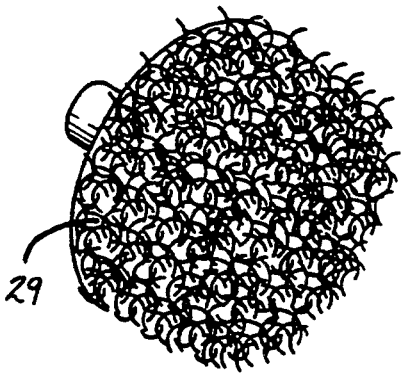
FIG. 4 is an isometric illustration of a steel wool brush structure.
Figure 5:
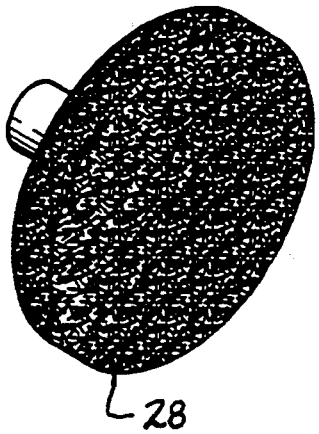
FIG. 5 is an isometric illustration of a tightly woven brush head.
Figure 6:
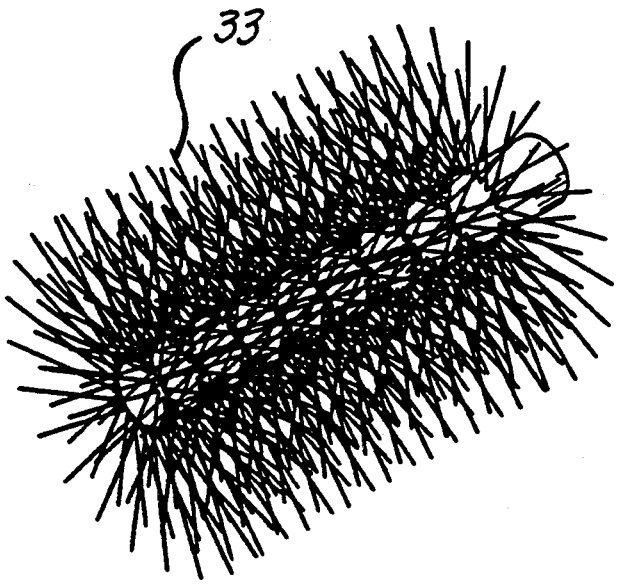
FIG. 6 is an isometric illustration of a bristle brush head structure.

The FIG. 4 illustrates the use of a steel wool brush head 29 optionally employed, in addition to the brush head 28 of a tightly woven material. Further, a bristle brush head 33 may be employed in use.

Relative securement of the brush heads may be employed utilizing threaded interconnection, set screws, or any other convenient manner available to one of ordinary skill in the art.

The FIG. 1 indicates the use of housing first and second openings 30 and 31, wherein the first opening 30 receives the speed control switch plate 27 slidingly therealong, wherein the speed control switch plate 27 is mounted to a mounting plate 32 slidably directed to an interior surface of the housing wall, as illustrated in FIG. 4, such that the mounting plate 32 includes an indicator face 32*a* to provide indication through the second opening 31 of the relative speed provided by the speed control switch member 34. A third opening in the housing 36 permits sliding displacement of the reversing switch 26 therethrough.

Figure 2:
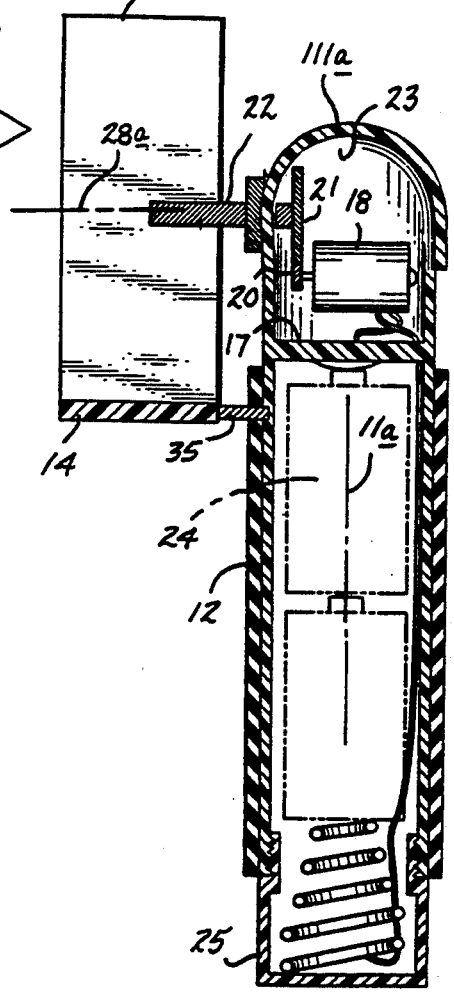
FIG. 2 is an orthographic view, taken along the lines 2—2 of FIG. 1 in the direction indicated by the arrows.
Figure 3:
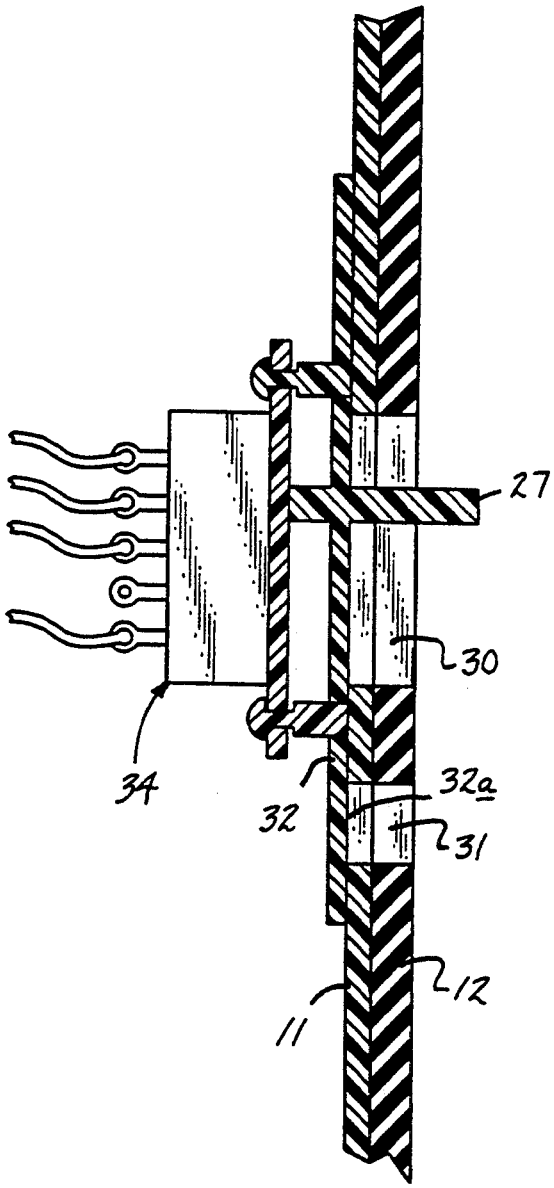
FIG. 3 is an orthographic partial view, taken along the lines 3—3 of FIG. 1 in the direction indicated by the arrows.

Access to the batteries 24, as illustrated in FIG. 2, is provided by the use of a removable end cap 25 threadedly directed into a lowermost end of the housing 11, as illustrated.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A rotary scrubber apparatus, comprising, an elongate housing symmetrically oriented about a housing axis, with the housing including an exterior surface, said exterior surface having a resilient sheath positioned thereabout, with the housing having a shield mounting rod fixedly mounted to the housing, with the shield mounting rod formed of a flexible shape retentive material, with a U-shaped splash guard mounted to the shield mounting rod, the splash guard having a first rigid plate fixedly mounted to the mounting rod, the first plate having a first side and a second side, with a second plate mounted to the first side and a third plate mounted to the second side, with the second plate and the third plate formed of a resilient material, drive means mounted within said housing, said drive means including an output shaft directed through the housing in a fluid sealing relationship relative to the housing, with a rotary brush mounted to the output shaft said shield being positioned circumferentially relative to said brush to deflect fluid therefrom, and switch means for effecting selective actuation of said drive means.

2. An apparatus as set forth in claim 1 wherein the housing includes a housing web defining a hermetically sealed chamber within said housing between the housing web and an uppermost end of the housing within said housing, the housing chamber including a drive motor, said drive motor having a drive motor output shaft, and said drive motor output shaft in mechanical communication with said output shaft.

3. An apparatus as set forth in claim 2 wherein said housing includes a first opening, a second opening, and a third opening directed through said housing, said first opening including a reversing switch, said reversing switch in electrical communication with said drive motor to effect selective rotation and contra-rotation of said drive motor, and said switch means further includes a speed control switch member, the speed control switch member in electrical communication with said drive motor to effect rotation of said drive motor at a plurality of rotary speeds, wherein said speed control switch member includes a switch plate, with said switch plate projecting through said second opening, said switch plate having a mounting plate mounted within said housing in contiguous communication within said housing within an interior surface of said housing, and said mounting plate including an indicator face, said indicator face in facing relationship through said third opening.

* * * * *